United States Patent [19]

Gingerich et al.

[11] 4,233,931

[45] Nov. 18, 1980

[54] ENVELOPE FEED APPARATUS

[75] Inventors: David L. Gingerich, San Bruno, Calif.; Robert Cohn, Omaha, Nebr.

[73] Assignee: Champion International Corporation, Stamford, Conn.

[21] Appl. No.: 901,333

[22] Filed: May 1, 1978

[51] Int. Cl.[3] ..... B05B 13/00

[52] U.S. Cl. ..... 118/239; 118/211; 118/230; 118/252; 271/271; 271/272; 271/182; 427/428; 156/442.2

[58] Field of Search ..... 271/275, 198, 202, 243, 271/271, 272, 273, 274, 229, 230, 182; 427/428; 118/211, 230, 239, 248, , 252; 156/442.2

[56] References Cited

U.S. PATENT DOCUMENTS

| | | | |
|---|---|---|---|
| 2,184,905 | 12/1939 | Brintnall | 271/202 X |
| 2,201,539 | 5/1940 | Kast | 271/243 |
| 2,287,720 | 6/1942 | Beasley | 118/239 |
| 2,371,179 | 3/1945 | Mendes | 118/252 X |
| 2,748,025 | 5/1956 | Sackett et al. | 118/239 X |
| 3,023,128 | 2/1962 | Affelder | 118/239 X |
| 3,149,834 | 9/1964 | Faeber | 271/275 X |
| 3,313,270 | 4/1967 | Labombarde et al. | 118/239 X |
| 3,945,633 | 3/1976 | Knopp | 271/202 X |
| 3,965,851 | 6/1976 | Cohn | 118/1 |
| 3,971,481 | 7/1976 | Longenecker et al. | 271/243 X |
| 4,062,320 | 12/1977 | Mortoly | 118/239 |

*Primary Examiner*—Shrive P. Beck
*Attorney, Agent, or Firm*—Evelyn M. Sommer

[57] ABSTRACT

A plurality of spaced, endless, coplanar, envelope feed belts have their upper runs interleaved and coplanar with the upper run of an envelope support belt at one end of the apparatus, which conveys the envelopes through an apparatus for applying sealant material to the flap closure portion and an adjacent body portion of the envelope. The envelopes are smoothly transferred from the feed belts to the support belt due to the simultaneous support of both belt systems at the delivery end of the apparatus. Another belt is then overlapped with the support belt at the delivery end of the apparatus to clamp the envelopes therebetween as they are conveyed through the sealant applying apparatus.

3 Claims, 3 Drawing Figures

ENVELOPE FEED APPARATUS

BACKGROUND OF THE INVENTION

1. Field of the Invention

This invention relates to an apparatus for feeding envelopes, and more particularly, an apparatus for feeding envelopes to a machine for applying sealant material to the flap closure portion and an adjacent body portion of the envelope whereby when the portions are placed in overlapping relationship and pressure is applied, the envelope may be sealed.

2. Description of the Prior Art

U.S. Pat. No. 3,965,851, issued June 29, 1976 to the same assignee of the present invention, discloses an apparatus for applying sealing material to envelopes. The apparatus includes a pair of overlapped conveyor belts between which envelopes are disposed and conveyed to a gum applying station and thence to a drying station to dry the gum applied to the flap closure and an adjacent body portion of the envelope. In order that the envelopes may be removed from the same side of the apparatus as they are fed, thereby increasing the efficiency and speed of operation, the overlapping belts which convey the envelopes through the apparatus are separated so that the envelopes may be fed between the belts and removed from the belts at the completion of the operation. The envelopes are fed between the overlapping belts by a roller conveyor system at the point at which the belts come together adjacent the entrance to the apparatus.

In our copending application being filed concurrently herewith, an apparatus for applying sealing material to the flap closure and an adjacent body portion of the envelope is disclosed which is an improvement over the apparatus disclosed in U.S. Pat. No. 3,965,851.

Specifically, a main endless belt cooperates with three overlapping belt systems for conveying the envelopes through the apparatus and past a sealing material applicator station and a pair of drying stations. The conveyor belt system employed in the improved apparatus provides for greater contact area between the overlapping belt conveyor systems for the envelopes, thus permitting the apparatus to be more compact and portable.

The present invention relates to an improved envelope feed apparatus for such sealant applying apparatus, in which the envelopes are fed serially and positively transferred without slipage between the overlapping belt systems at the entance to the apparatus.

SUMMARY OF THE INVENTION

In accordance with the present invention, the feed apparatus comprises a plurality of coplanar, spaced belts. The belts of the lowermost or base support conveyor in the sealant applying apparatus are interleaved with and disposed coplanar with the belts of the feed apparatus so that transfer of the envelopes from the feed apparatus to the support conveyor in the sealant applying apparatus is accomplished prior to the envelopes reaching the ends of the upper runs of feed conveyor belts. This assures that the envelopes will be on the support conveyor and properly timed relative to an adhesive applicator in the sealant applying apparatus, prior to the overlapping clamp belt of the sealant applying apparatus being brought into contact with the envelopes. Accordingly, smooth positive traction and support is achieved for transfer of the envelopes to the sealant applying apparatus prior to the envelopes entering the apparatus between the overlapping belts.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
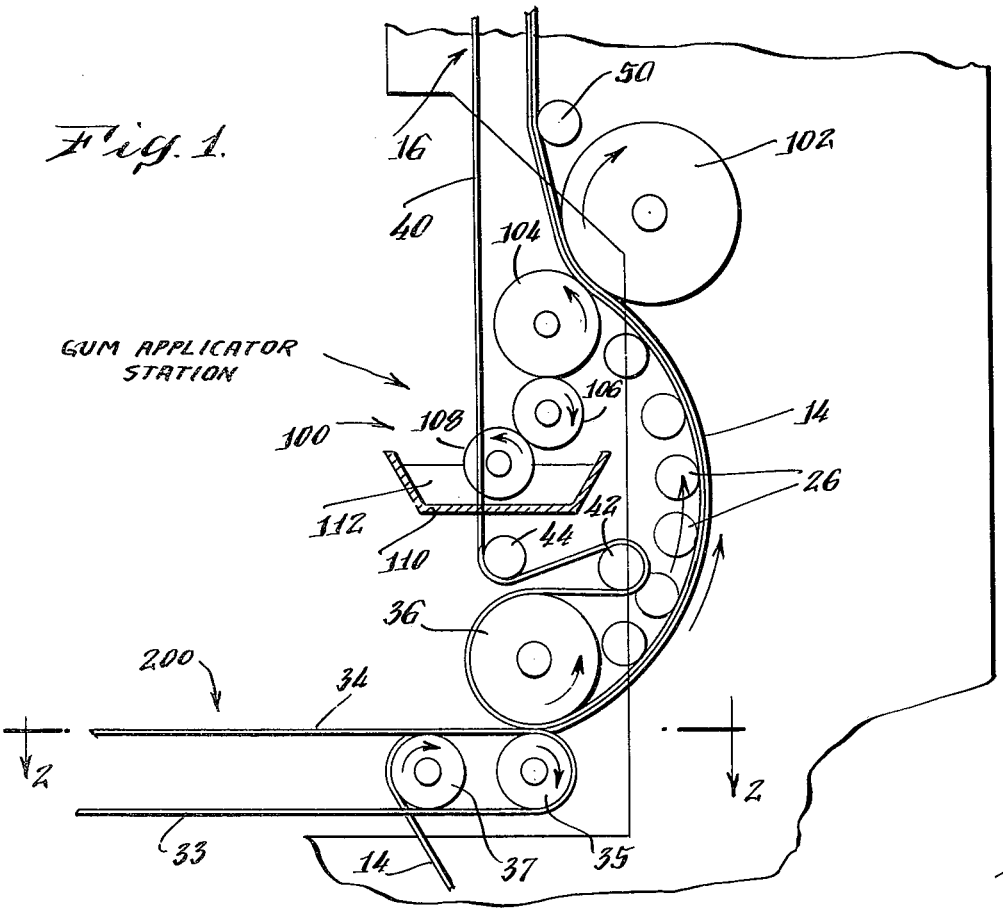
FIG. 1 is a partial schematic, side elevational view of the envelope feed apparatus of the present invention feeding envelopes into a sealant applying apparatus including a pair of overlapping belts which convey the envelope through the apparatus past a gum applying station and drying station.

Referring now to the drawings in detail, wherein like numerals indicate like elements throughout the several views, the envelope feed apparatus 200 of the present invention is adapted to convey envelopes whose enclosure flap has been unfolded onto a run of a lower conveyor 14 in an apparatus for applying sealant material to the closure flap of the envelope and an adjacent body portion. The conveyor 14 comprises one or more parallel, coplanar, belts 202 which are overlapped by parallel belts 40 of a first auxiliary conveyor of the sealant applying apparatus for clamping the envelopes therebetween and conveying them past a sealant applying station A.

The sealant applicator station A includes a sealant applying roller 104 and one or more gum impression rollers 102. The sealant applying roller 104 is in contact with belt 40 whereas roller 102 is in contact with lower belt 14. The belts 40 and 14 with the envelopes clamped therebetween pass through the nip rollers 102 and 104 which apply the sealant material to the flap closure and an adjacent body portion of the envelopes as disclosed fully in U.S. Pat. No. 3,965,851 and are then conveyed to a suitable drying station or stations. The belts 14 and overlapping belts 40 are separated at the exit end of the apparatus and the envelopes collected.

The sealant material is disposed in a suitable container 110 and a pair of sealant transfer rollers 106 and 108 transfer the sealant 112 to the sealant applying roller 104.

Figure 2:
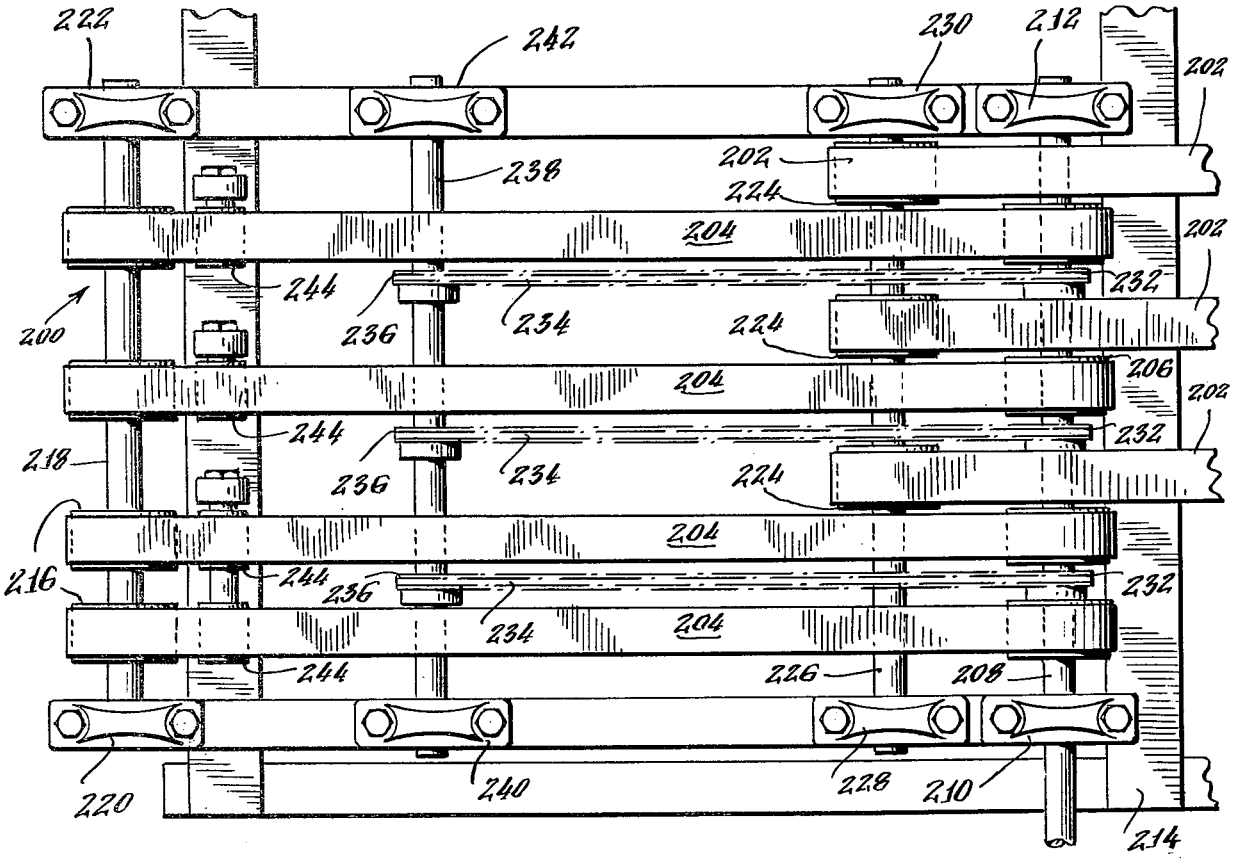
FIG. 2 is a top plan view of the envelope feed apparatus of the present invention as viewed along the plane indicated by lines 2—2 of FIG. 1.
Figure 3:
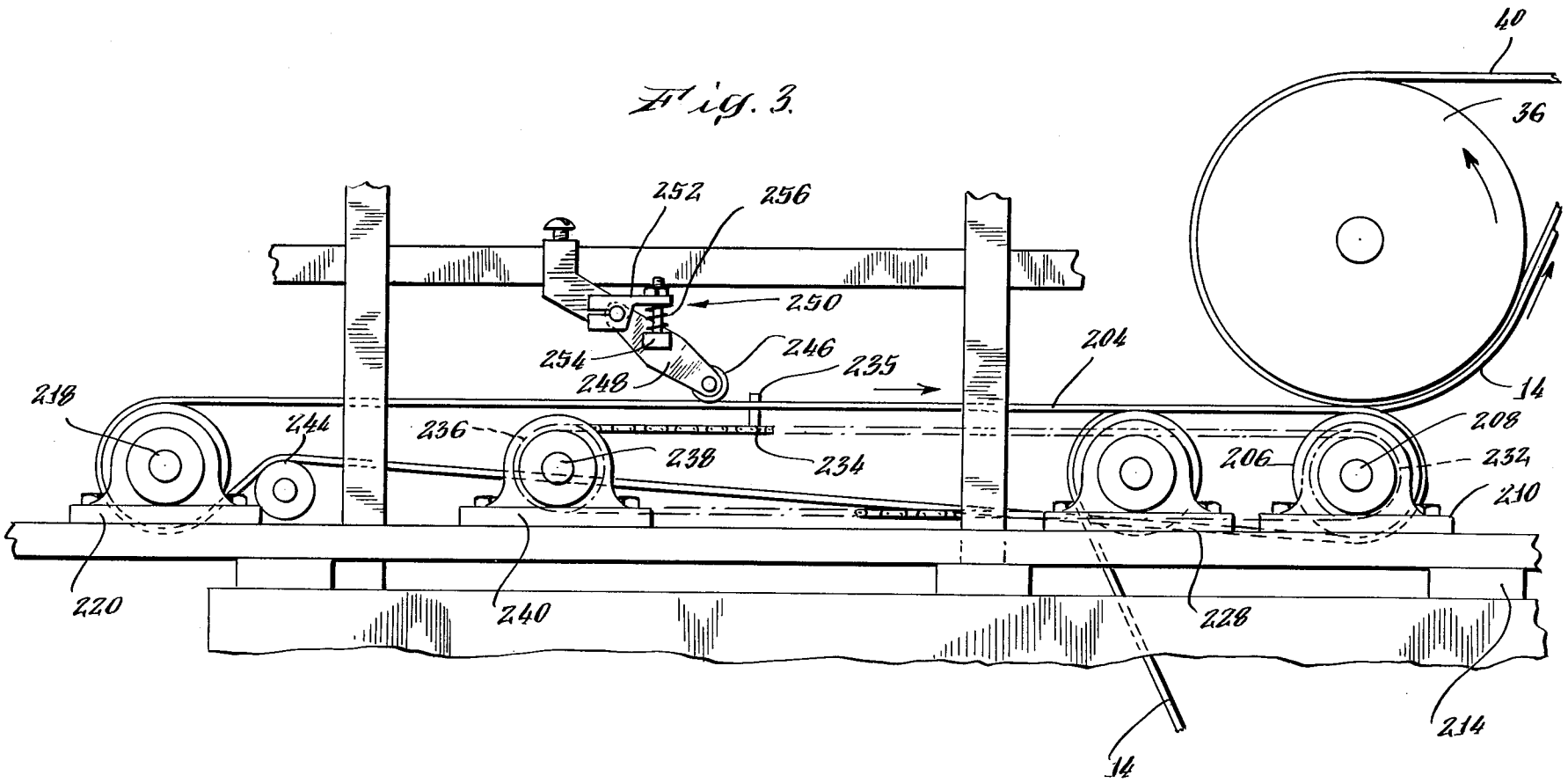
FIG. 3 is a side view in elevation of the envelope feed apparatus of FIG. 2.

FIGS. 2 and 3 illustrate the envelope feed apparatus 200 for feeding the envelopes between conveyors 14 and 40.

The apparatus 200 comprises a plurality of endless conveyor belts 204. The conveyor belts 204 are disposed in coplanar spaced array. One end of each belt 204 is entrained about a pulley 206 fixed to a shaft 208. Shaft 208 is mounted between bearing blocks 210 and 212 seated on a fixed frame 214 of the apparatus 200. The opposite end of each belt 204 is entrained about a pulley 216 fixed to a shaft 218. Shaft 218 is rotatably mounted between a pair of bearing blocks 220 and 222 mounted on the frame 214 of the apparatus 200.

As shown in FIG. 2, each individual belt 202 of conveyor 14 forming the support belt for conveying the envelopes through the apparatus for applying the sealing material is disposed coplanar with and between adjacent ones of the belts 204. The belts 202 extend to a location intermediate the ends of the top run of each of the conveyor belts 204 and are mounted on pulleys 224 fixed to a shaft 226 rotatably disposed between a pair of bearing blocks 228 and 230 mounted on the frame 214 of apparatus 200. Belts 202 are driven from the main drive of the sealant applying apparatus.

Also mounted between each of the belts 202 and 204 on shaft 208 is a sprocket 232 in driving engagement with a timing chain 234 entrained about an idler sprocket 236 fixed to a shaft 238. Shaft 238 is rotatably mounted between bearing blocks 240 and 242 fixed to frame 214. Upright dogs 235 (see FIG. 3) are mounted on each chain 234 at approximately 15 inch centers.

Pulleys 206 are larger in diameter than sprockets 232, so that the speed of each chain 234 is somewhat slower than each belt 204. Accordingly, envelopes placed on belts 204 will move over the chains 234 at a relatively faster rate to catch up with a dog 235. The dog 235 will hold one envelope in a predetermined spaced relation from the succeeding envelope to assure that they are fed in spaced relation onto belts 202 from belts 204. The speed of the dogs 235 is the same as the speed of movement of the belts 202 of conveyor 14.

Pulleys 244 fixed to frame 214 are disposed beneath the lower run of each of the belts 204 to provide suitable tension on the belts. The envelopes carried on the upper run of each belt 204 may be frictionally held on the belt by a roller 246 connected to an arm 248 pivotably and slidably mounted upon the frame 214. The vertical position of and the tension supplied by arm 248 on the envelopes is adjusted by a mechanism 250 including a fixed lever arm 252 attached to a vertically adjustable spring loaded bracket 254 at one end thereof carried by arm 248. By adjusting the vertical position of the bracket 254 (and arm 248) against the bias of spring 256 on the end of arm 252, the frictional contact between roller 246 and the top run of each belt 204 (and an envelope thereon) can be varied.

In use, envelopes are fed onto each of the parallel coplanar belts 204. Each envelope is transferred prior to the end of the upper run of each belt 204 onto the coplanar interleaved belts 202 forming the support conveyor 14 in the sealant material applying apparatus. The envelopes are spaced by dogs 235 on chains 234 and are fed in spaced relation to belts 202 at the speed thereof. The envelopes are then conveyed by belts 202 into the sealant applying apparatus between belt 14 and the belt 40.

Because of the transfer to the coplanar belts 202 prior to contact being completely lost between the belts 204 and the envelope, positive transfer of the envelopes to the apparatus for applying the sealant material is effected so that the envelopes are smoothly fed into the apparatus.

What is claimed as new is:

1. In an apparatus for applying a sealant material to the flap closure and adjacent body portion of an envelope, said apparatus including at least one endless primary belt for supporting and conveying said envelopes between it and an overlapping belt through said apparatus and means for applying sealant material to the flap closure and an adjacent body portion of said envelope, the improvement comprising:

means for feeding said envelopes onto said endless primary belt, said means including:

a first shaft means;

a plurality of pulleys spaced along said first shaft means and affixed thereto;

a group of coplanar and spaced endless secondary belts interleaved with said endless primary belt, and with each of said pulleys on said first shaft means being drivingly connected to one of said secondary belts and wherein said endless primary belt has an upper run disposed coplanar to the upper run of each of said secondary belts and intermediate the ends of the upper runs of said secondary belts;

a drive means operatively connected to said first shaft means;

means for holding said envelopes on said group of secondary belts, said means including a vertically adjustable roller in contact with the upper run of each said secondary belts;

first sprocket means fixed to each of said pulleys of said first shaft means, said first sprocket means having a diameter less than the diameter of said pulleys, such that the peripheral surface speed of said sprocket means is less than the peripheral surface speed of said pulleys;

a second shaft means;

second sprocket means fixedly connected to said second shaft means;

an endless chain, said chain being drivingly connected to said first and second sprocket means, said endless chain moving at a speed equal to the speed of said primary belt and slower than the speed of said secondary belts; and a plurality of spaced upright dogs connected to said endless chain, whereby the envelopes being conveyed on said secondary belts move at a speed faster than said dogs on said endless chain, such that each envelope catches up with and is restrained by an individual dog thereby spacing each envelope a predetermined distance from the succeeding envelope and conveying said envelopes at a speed equal to said primary belt thereby assuring that the envelopes are securely fed in spaced relation onto said endless primary belt.

2. In an apparatus in accordance with claim 1, means for tensioning each of said endless belts in said group of belts.

3. In an apparatus in accordance with claim 2 wherein said tensioning means includes a pulley in rotational contact with the lower run of each belt in said group of belts.

* * * * *